US011109127B2

(12) United States Patent
Walter et al.

(10) Patent No.: US 11,109,127 B2
(45) **Date of Patent: *Aug. 31, 2021**

(54) PORTABLE SPEAKER APPARATUS AND METHOD

(71) Applicant: POW Audio Inc., Boxford, MA (US)

(72) Inventors: Cameron V. Walter, Boxford, MA (US); Glen V. Walter, Boxford, MA (US); Gabor Paulke, Littleton, NH (US); Michael Arthur Siegel, Somerville, MA (US); Michael G. Zartarian, Belmont, MA (US)

(73) Assignee: POW AUDIO INC., Boxford, MA (US)

( * ) Notice: Subject to any disclaimer, the term of this patent is extended or adjusted under 35 U.S.C. 154(b) by 245 days.

This patent is subject to a terminal disclaimer.

(21) Appl. No.: 16/509,208

(22) Filed: Jul. 11, 2019

(65) Prior Publication Data

US 2020/0084527 A1 Mar. 12, 2020

Related U.S. Application Data

(63) Continuation of application No. 16/124,524, filed on Sep. 7, 2018, now Pat. No. 10,397,677.

(51) Int. Cl.

| | |
|---|---|
| ***H04R 1/02*** | (2006.01) |
| ***H04R 3/00*** | (2006.01) |
| ***H04R 1/28*** | (2006.01) |

(52) U.S. Cl.

CPC ..... *H04R 1/025* (2013.01); *H04R 1/2811* (2013.01); *H04R 3/00* (2013.01); *H04R 1/026* (2013.01);

(Continued)

(58) Field of Classification Search

CPC ..... H04R 1/2811; H04R 1/02; H04R 1/028; H04R 1/2803; H04R 5/02

See application file for complete search history.

(56) References Cited

U.S. PATENT DOCUMENTS 6,292,573 B1 * 9/2001 Zurek ..... H04R 1/2811 379/428.01

8,284,972 B2 10/2012 Lin (Continued)

FOREIGN PATENT DOCUMENTS

| | | |
|---|---|---|
| CN | 112640484 | 4/2021 |
| JP | 2007-129539 A | 5/2007 |

(Continued)

OTHER PUBLICATIONS

Non-Final Office Action, U.S. Appl. No. 16/124,524, entitled "Portable Speaker Apparatus and Method", dated Feb. 20, 2019.

(Continued)

*Primary Examiner* — Amir H Etesam

(74) *Attorney, Agent, or Firm* — Hamilton, Brook, Smith & Reynolds, P.C.

(57) ABSTRACT

A speaker apparatus, method, and system with a user selectably expandable chamber is provided. The chamber in its expanded state enhances the speaker's acoustical properties using a relatively stiff back plate of the speaker apparatus. The chamber in its collapsed state provides a thin profile for increased portability or low profile mounted solutions. The speaker is compatible with current electronics and may magnetically attach to a target surface such as a surface of a handheld device. The target surface may effectively supplement the stiffness of the back plate.

20 Claims, 10 Drawing Sheets

(52) U.S. Cl.
CPC ..... *H04R 1/2826* (2013.01); *H04R 2201/021* (2013.01); *H04R 2205/021* (2013.01); *H04R 2400/11* (2013.01); *H04R 2420/07* (2013.01); *H04R 2420/09* (2013.01); *H04R 2499/11* (2013.01)

(56) References Cited

U.S. PATENT DOCUMENTS

| | | | |
|---|---|---|---|
| 8,792,232 | B2 | 7/2014 | Richardson |
| 8,976,512 | B2 | 3/2015 | Richardson et al. |
| D728,520 | S | 5/2015 | Zhang |
| D728,521 | S | 5/2015 | Zhang |
| D728,522 | S | 5/2015 | Zhang |
| D728,525 | S | 5/2015 | Zhang |
| D728,526 | S | 5/2015 | Zhang |
| 9,114,923 | B2 | 8/2015 | Richardson et al. |
| 9,295,174 | B2 | 3/2016 | Witter et al. |
| 9,351,066 | B2 | 5/2016 | Walter et al. |
| 9,402,122 | B2 | 7/2016 | Richardson et al. |
| D780,742 | S | 3/2017 | Guerdrum et al. |
| 9,654,605 | B2 | 5/2017 | Goldfain et al. |
| 9,716,401 | B2 | 7/2017 | Wojcik |
| 9,774,713 | B2 | 9/2017 | Guerdrum et al. |
| 9,807,211 | B2 | 10/2017 | Guerdrum et al. |
| 10,027,788 | B2 | 7/2018 | Pierce |
| D833,423 | S | 11/2018 | Guerdrum et al. |
| 10,397,677 | B1 | 8/2019 | Walter |
| 2004/0156523 | A1 | 8/2004 | Tuason et al. |
| 2004/0252859 | A1 | 12/2004 | Saiki |
| 2007/0284183 | A1 | 12/2007 | Whitaker |
| 2008/0118098 | A1 | 5/2008 | Irby et al. |
| 2008/0279406 | A1 | 11/2008 | D'Hoogh |
| 2010/0194578 | A1 | 8/2010 | Zhang |
| 2012/0063626 | A1 | 3/2012 | Peng |
| 2012/0163620 | A1 | 6/2012 | Zhang |
| 2013/0003984 | A1 | 1/2013 | Belafonte et al. |
| 2014/0093097 | A1 | 4/2014 | Zhang |
| 2015/0049895 | A1 | 2/2015 | Walter et al. |

FOREIGN PATENT DOCUMENTS

| | | | |
|---|---|---|---|
| WO | WO 2013/078916 | A1 | 6/2013 |
| WO | WO 2014/074074 | A1 | 5/2014 |
| WO | 2015026618 | A1 | 2/2015 |
| WO | WO 2017/044733 | A1 | 3/2017 |
| WO | 2020050871 | A1 | 3/2020 |

OTHER PUBLICATIONS

Notice of Allowance, U.S. Appl. No. 16/124,524, entitled "Portable Speaker Apparatus and Method", dated May 13, 2019.

Corrected Notice of Allowance, U.S. Appl. No. 16/124,524, entitled "Portable Speaker Apparatus and Method", dated Jul. 17, 2019.

DrFaulken, Gibberish Is My Native Language, "Powered Portable Speaker Shootout," [online], Dec. 13, 2011 (19 pages), [retrieved on Jul. 15, 2014]; Retrieved from the Internet URL: http://journal.drfaulken.com/powered-portable-speaker-shootout/.

Otter Box, "UniVerse Case System," https://www.otterbox.com/en-us/universe-case-system (5 pages) retrieved on Sep. 7, 2018.

SmarTV Ltd, "TranXformerTM," http://www.tranxformer.com (6 pages) (last visited Jun. 2015).

International Search Report and the Written Opinion of the International Searching Authority for Int'l Application No. PCT/US2014/051037, titled: "Expandable Speaker," dated Nov. 24, 2014.

https://www.otterbox.com/en-us/ip.html, Jun. 2017 (6 pages).

International Search Report and the Written Opinion of the International Searching Authority for Int'l Application No. PCT/US2018/067658, titled: "Portable Speaker Apparatus and Method," dated May 21, 2019.

Notification Concerning Transmittal of International Preliminary Report on Patentability for Int'l Application No. PCT/US2018/067658 entitled, "Portable Speaker Apparatus and Method," dated Mar. 18, 2021.

* cited by examiner

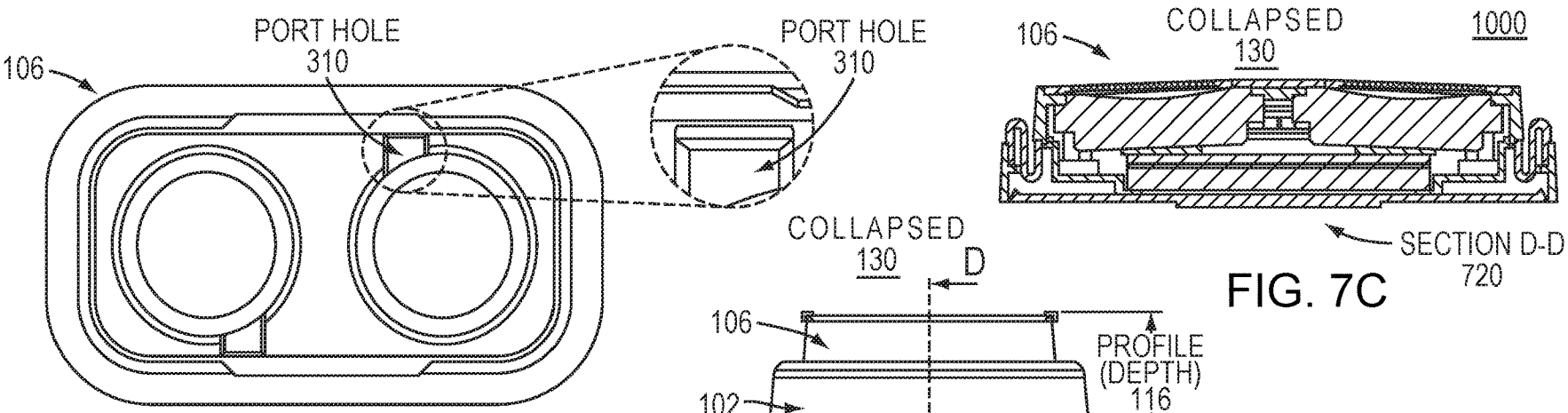
FIG. 7A
FIG. 7C
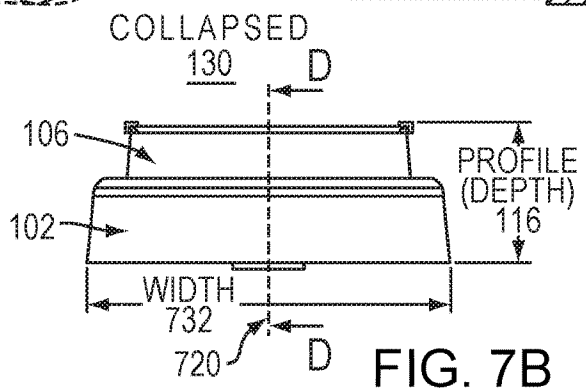
FIG. 7B
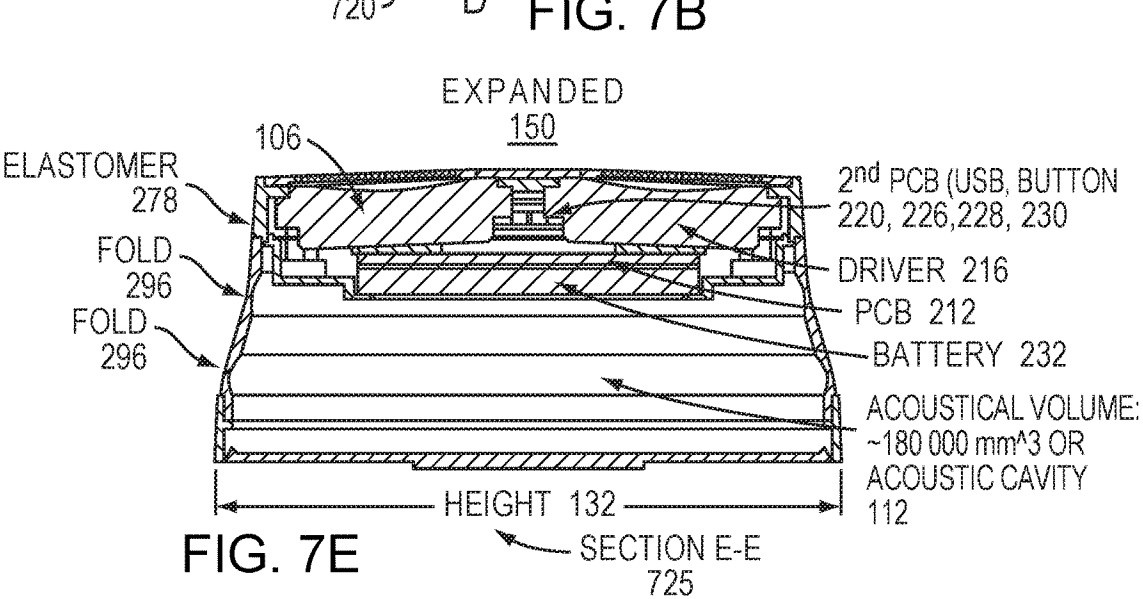
FIG. 7E
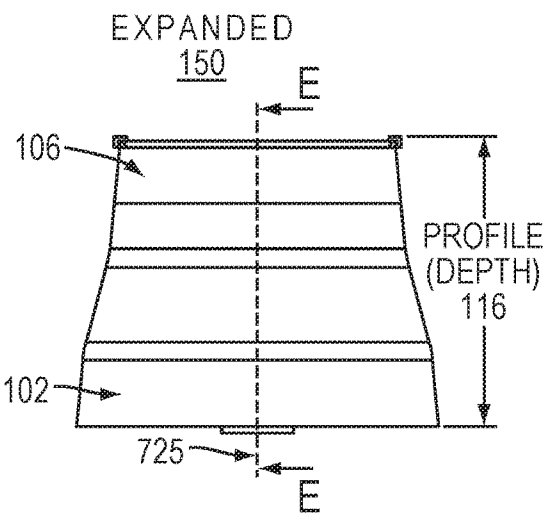
FIG. 7D

ACOUSTICAL PROPERTIES

PORTABLE SPEAKER APPARATUS AND METHOD

RELATED APPLICATIONS

This application is a continuation of U.S. application Ser. No. 16/124,524, filed on Sep. 7, 2018. The entire teachings of the above application are incorporated herein by reference.

BACKGROUND

The increased use of technology and portable computers has generated a corresponding increase in the need for portable audio technology. This ever-increasing need for portable audio technology requires corresponding audio devices which are compact, portable, and effective.

A speaker, also known as an audio speaker or audio module, is a commonly used audio device. Speakers are used to convert electrical signals received from a sound generator or source (such as computers) into audible or audio signals. In this way, a speaker is an electroacoustic transducer that produces sound in response to an electrical signal input. Speakers include loudspeakers, computer speakers, and other types of speakers.

SUMMARY

Currently, there is a need in the industry for audio modules or speakers that are portable, effective, and compatible with portable source devices such as smart phones, digital music players, and the like. The apparatus, systems, and methods described herein provide a solution to this need. The apparatus, systems, and methods described herein provide a user-selectably expandable chamber of an audio module or speaker that converts electronic signals to audible sound. More specifically, embodiments provide an acoustic chamber having one relatively stiff wall in combination with user-selectably expandable-collapsible elastomeric walls. The one relatively stiff chamber wall serves as an acoustic back plane among the other chamber walls. The chamber, when in an expanded state, enhances the audio module's or speaker's acoustical properties, yet also when in a collapsed state provides portability and a thin profile. The audio module or speaker may be compatible with current electronic devices or other sources of input signals for producing subject audio (sound). The audio module or speaker may be compatible with other speakers including but not limited to an expandable speaker such as that of U.S. Pat. No. 9,351,066 (incorporated herein by reference in its entirety).

The present invention is directed to a portable speaker (e.g., audio device) apparatus, system, and method. In an embodiment, the portable speaker apparatus, system, and method includes a speaker assembly and a frame. The frame has a back plate with an exterior facing surface on one side and an opposite side referred to as the interior side (or surface) of the plate. The back plate may be relatively stiff with respect to other sides of the speaker apparatus. The exterior facing surface is attachable to a target planar surface of a handheld device or input signal source. For nonlimiting example, in on embodiment the exterior facing surface may be magnetic or may enable magnetic coupling to the target planar surface of the handheld device.

The speaker assembly may comprise speaker elements. The frame carries the speaker assembly such that the speaker elements are spaced apart from the interior side of the back plate.

In embodiments, the speaker assembly may have a user selectable collapsed state and user selectable expanded state. In the collapsed state, the speaker assembly minimizes overall profile (e.g., width or thickness) of the speaker apparatus. More specifically, in the collapsed state the speaker assembly minimizes outward extension of the speaker elements from the interior side or surface of the back plate. In the expanded state, the speaker assembly has an acoustic cavity (or acoustical cavity, chamber, or volume, etc.) that is formed between the speaker elements and the back plate (interior side). The interior side or surface serves as a chamber wall that is relatively stiffer than the rest of the chamber walls. Subject soundwaves resonate off the stiff surface (interior side of the back plate) and travel through the acoustic cavity to the other chamber walls made of relatively softer material. The resonating sound waves exit the acoustic cavity through a port, time delayed but in phase with the sound delivered through the speaker elements. Thus, the sound delivered through the port accentuates (additively enhances) the sound delivered through the speaker elements. Other embodiments may deliver sound through the relatively soft chamber walls instead of or in addition to the port in time delayed but in frequency phase with sound delivered through the speaker elements.

In an embodiment, the speaker apparatus or system is user selectively magnetically coupled or uncoupled to the planar surface of the handheld device by the exterior facing surface of the back plate. Once coupled, the speaker assembly is user selectively expanded and collapsed in directions with respect to the coupled back plate surface and planar device surface. In an embodiment, the speaker assembly has port holes for drawing air to create the volume (e.g. acoustic cavity) when being changed from the collapsed state to the expanded state. In an embodiment, the acoustic cavity includes a volume of air. In an embodiment, the speaker elements are spaced across the volume from the back plate, and the back plate coupled to a target planar surface supports the generation of the enhanced overall acoustic sound.

In an embodiment, the speaker elements include but are not limited to any of a battery, other power source, pair button (i.e. for Bluetooth pairings), repeater button or transistor (for electronic relaying of speaker generated sound), universal serial bus (USB) connector, and a sound driver.

In an embodiment, the speaker assembly employees an elastomer material that forms the user selectable expandable-collapsible chamber walls.

In an embodiment, the frame further includes but is not limited to any of an outer frame, a kickstand, and/or shock absorbing feet. The interior facing side of the back plate forms the relatively stiff chamber wall; and the opposite or exterior facing side interfaces with the handheld device (target planar surface thereof), tabletop or other target use surface. In embodiments, the relatively stiffer wall of the acoustic cavity is formed by the back plate interfacing with the target planar surface. In such embodiments, a variety of light weight or other materials may be used for the back plate. In turn, the back plate in cooperation with the target planar surface (such as a table top or wall, etc.) produces the working stiffness of the subject wall (interior facing surface of the back plate).

In an embodiment the handheld device includes a smart phone. In an embodiment the handheld device includes a sleeve, jacket, or cover of metal-like material that has magnetic properties or is magnetically attractable to the portable speaker.

In an embodiment, input signals are wirelessly transferred to and received by the portable speaker. Such wireless communication is employed even though the speaker apparatus is physically coupled to the input signal source (held handheld device), i.e., backplate exterior facing surface and the target planar surface of the hand-held device are magnetically or otherwise coupled together.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

FIGS. 1A-8 are perspective and schematic views of embodiments of the present invention.

FIGS. 1A-1C are perspective views of a speaker apparatus, system, and method embodying principles of the present invention.

FIG. 4 is a schematic view of the port holes, port tube, and support system of the speaker apparatus, system, and method of FIGS. 1A-1C.

FIGS. 7A-7E are schematic and cross-sectional views with dimensional characteristics of the speaker apparatus, system, and method in an embodiment.

FIG. 8 is a schematic illustration of soundwaves and sound generation of embodiments.

DETAILED DESCRIPTION

A description of example embodiments follows.

The present invention is directed to a portable speaker (e.g., audio device) apparatus, system, and method with user selectably collapsing acoustic chamber. According to some embodiments, the speaker apparatus, system, and method is formed of a frame and a speaker assembly. The frame includes a back plate having an interior facing side (or surface) and an exterior facing side (or surface). The speaker assembly includes mechanical components and electrical components (e.g., speaker elements). The speaker apparatus, system, and method generates sound through the speaker elements that advantageously combines with sound generated in the acoustic chamber by sound waves resonating off the back plate interior surface and exiting through a port. The sound exiting the port is in phase (frequency wise) with the sound generated through the speaker elements. For portability convenience, embodiments may be removably attached or coupled to a handheld device or other input signal source device.

FIGS. 1-8 are perspective and schematic views of embodiments of the present invention. For nonlimiting example, illustrated in FIGS. 1A-6D are a speaker (e.g., audio device) apparatus, system, and method 1000 of the present invention.

Figure 1C:
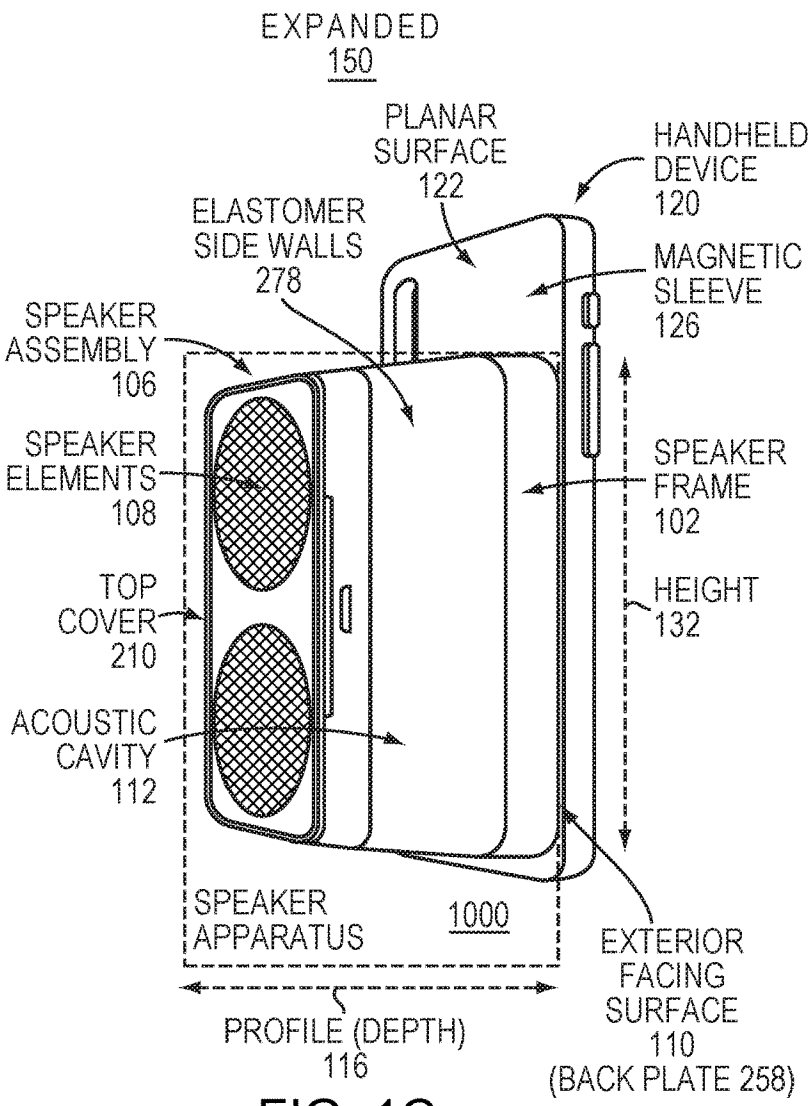
Figure 1B:
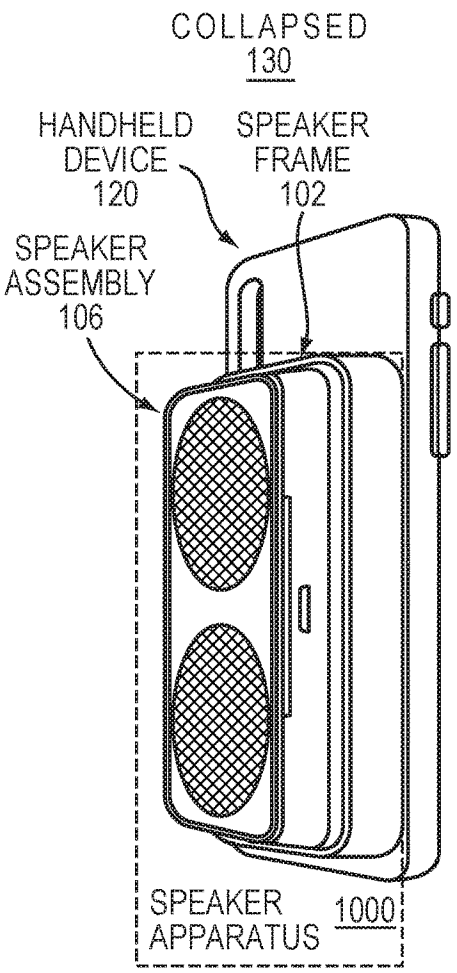
Figure 1A:
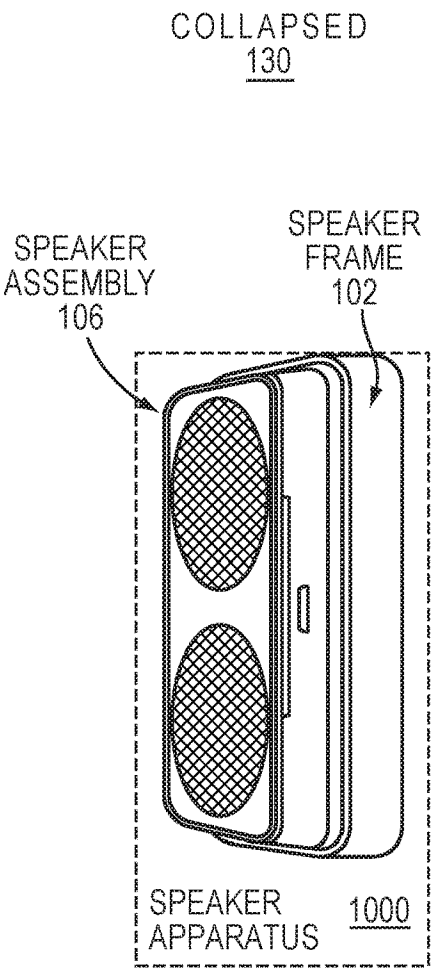

FIGS. 1A-1C are perspective views of the speaker apparatus, system, and method 1000. In the shown embodiment, the speaker apparatus, system, and method 1000 include a frame or lower housing 102. The frame 102 includes a back plate 258 (FIGS. 3A-3B) with an exterior facing surface 110 that is removably attachable to a planar surface 122 of a handheld device 120. The exterior facing surface 110 is also referred to herein as the attaching (or interfacing) plane 110.

Figure 2C:
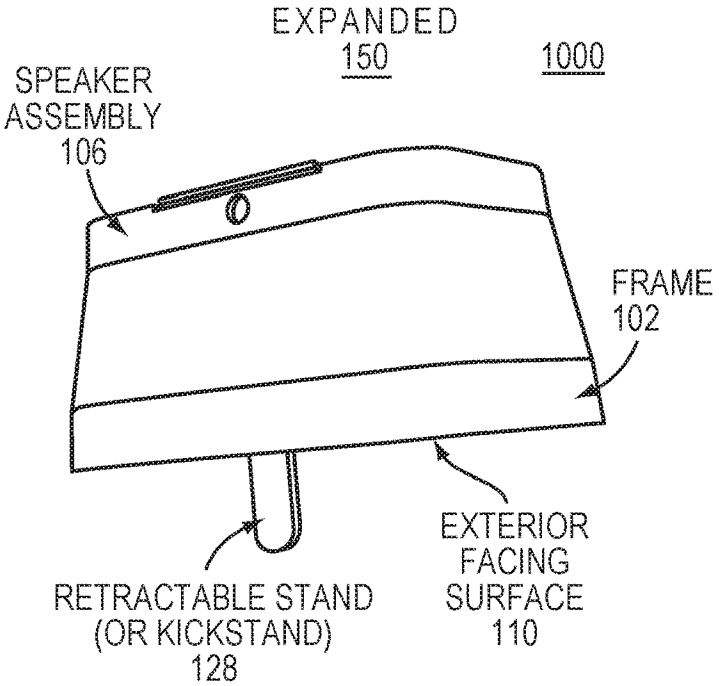
FIGS. 2A-2C are perspective views of a speaker apparatus, system, and method of FIGS. 1A-1C and alternatives decoupled from a target surface having a magnetic sleeve or jacket for magnetically coupling to the speaker apparatus.

For portability purposes, in embodiments the exterior facing surface 110 may have magnetic properties or may enable magnetic coupling to the target planar surface 122 of the handheld device 120. For nonlimiting example, one embodiment has disc shaped earth magnets 280 seated in corner areas of the interior facing side 221 of the back plate 258 shown in FIG. 3A. In another embodiment, disk shaped magnets 260 are counter sunk into the corner areas of the exterior facing side 110 of back plate 258. FIG. 2B is illustrative. Various configurations are suitable. In turn, in embodiments the handheld device 120 of FIGS. 1A-1C includes a sleeve 126 that is formed of magnetically attractable material. In an embodiment, the handheld device 120 is a smart phone. A variety of coupling mechanisms between the speaker apparatus 1000 and handheld device 120 are suitable.

Figure 3A:
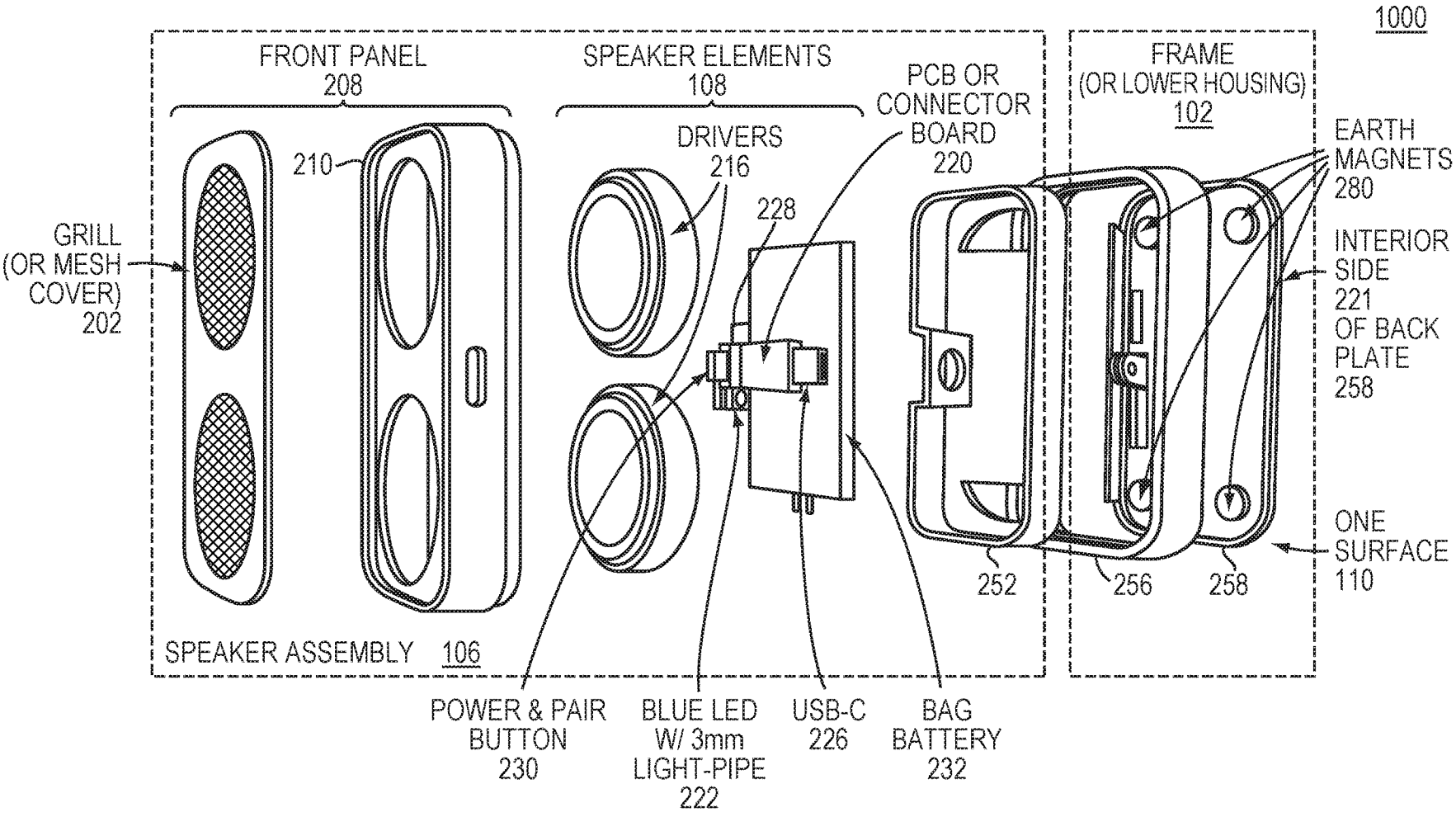
FIGS. 3A-3B are exploded views of a speaker assembly and frame of the speaker apparatus, system, and method of FIGS. 1A-1C minus the elastomer material exterior cover.

Returning to FIGS. 1A-1C, the frame 102 carries a speaker assembly 106 spaced across from the interior facing side 221 of the back plate 258 (FIG. 3A). The speaker assembly 106 comprises speaker elements 108. The speaker assembly 106 has sidewalls formed of an elastomeric material 278 enabling a user selectable collapsed state 130 and a user-selectable expanded state 150 of speaker assembly 106. In the collapsed state 130, the speaker assembly 106 minimizes an overall device profile (e.g. depth) 116 and protruding distance of the speaker elements 108. More specifically, in the collapsed state 130 the speaker assembly 106 minimizes outward extension of the speaker elements 108 from interfacing plane 110 of the frame 102 backplate 258 (and thus of the apparatus or system 1000).

In the expanded state 150, the speaker assembly 106 has an acoustic cavity (or chamber, volume, etc.) 112 that is formed between the speaker elements 108 and the frame backplate 258/interfacing plane 110. The other walls of the chamber 112 are formed by the elastomeric material 278 of the speaker assembly 106 and are smooth, non-stepped (so called memoryless) surfaces. The speaker apparatus 1000 is about 4 inches-4.5 inches (101.6 mm-114.3 mm) in overall height. The speaker apparatus 1000 is about 2.4 inches-2.5 inches (61 mm-63.5 mm) in overall width. The speaker apparatus 1000 is about 0.95 inch-0.97 inch (24.13 mm-24.64 mm) in depth when speaker assembly 106 is in the collapsed state 130. The speaker apparatus 1000 is about 2.0 inches-2.1 inches (50.8 mm-53.3 mm) in depth when the speaker assembly 106 (and the acoustic cavity 112) is expanded. The acoustic cavity 112 is about 244.4 cubic in.-271.5 cubic in. (180,000 cubic mm-200,000 cubic mm) in one embodiment. Other configurations and dimensions of speaker assembly 106, acoustic cavity 112, and portable speaker 1000 are suitable.

Figure 2A:
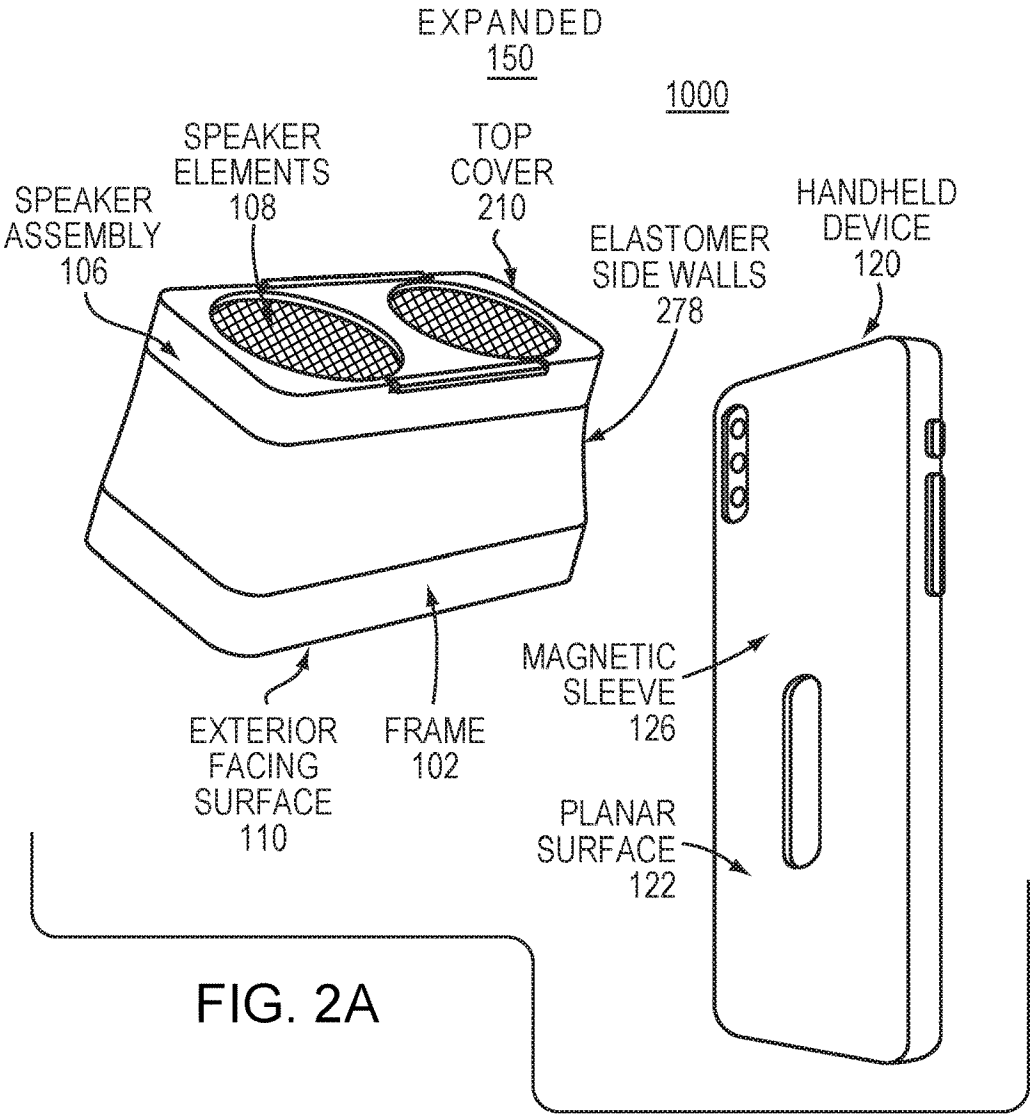
Figure 2B:
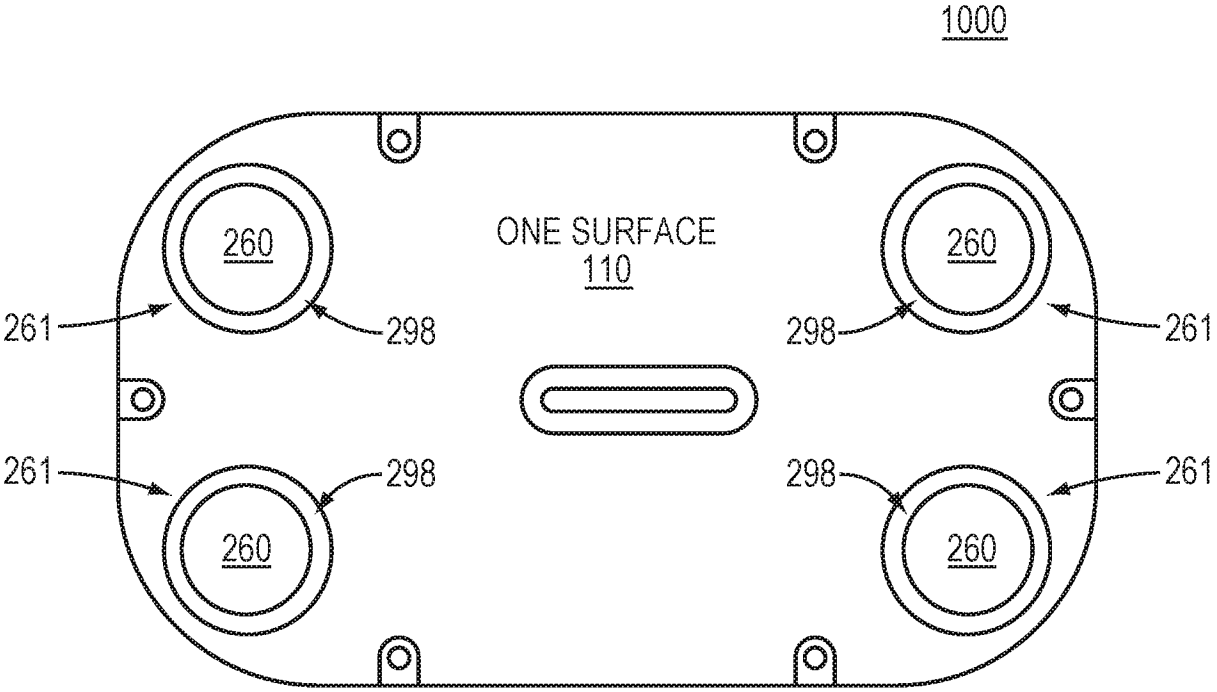

FIG. 2A is a perspective view of the speaker apparatus, system, and method 1000 decoupled from the handheld device 120. FIG. 2A illustrates the magnetically attractive sleeve 126 about handheld device 120. The magnetically attractive sleeve 126 effectively provides handheld device 120 for magnetic coupling to speaker apparatus 1000. In particular, the magnetic properties of the exterior facing surface 110 of the speaker frame back plate 258 can appropriately be attracted to and removably secured to the subject handheld device 120 wearing sleeve 126. In addition, speaker apparatus 1000 user-selectively decouples from the handheld device 120 and acts as a freestanding device as follows.

In FIG. 2A, the speaker apparatus 1000 is shown as a freestanding device with the speaker assembly 106 in the expanded state 150. In some embodiments, speaker apparatus 1000 may sit on an upper planar surface such as a tabletop as well as may magnetically removably attached to other planar metallic surfaces (such as vertically oriented metal cabinet walls, metal panel or door for nonlimiting example). In some embodiments, antivibration feet 261 are employed on the exterior facing surface 110 of the frame back plate 258 as shown in FIG. 2B. In one embodiment 1000, the antivibration feet 261 are positioned around the perimeter and/or corner areas of the exterior facing side of back plate 258. For each foot 261, a rubber ring 298 about the countersunk magnetic disk 260 forms the contact elements or interface to a target planar surface (e.g. handheld device 120/planar surface 122, tabletop, etc.). Other configurations in geometry, position/location, and/or material for antivibration feet 261 are suitable.

In other embodiments, speaker apparatus 1000 has a corresponding stand or retractable kickstand 128 shown in FIG. 2C for use of the speaker apparatus 1000 as a freestanding device.

Given the foregoing other configurations of speaker apparatus 1000 as a freestanding device are within the purview of those of ordinary skill in the art. Whether decoupled and freestanding, or coupled to the handheld device 120, speaker apparatus 1000 receives source signals from handheld device 120 (and or other sources) using wireless technology, such as Bluetooth protocol. As will be further detailed below, speaker assembly 106 (preferably in the expanded state 150) has speaker elements 108 wirelessly receive the source signals and transform them into audio signals (soundwaves). Some of the generated soundwaves are immediately delivered through to the speaker elements 108 while some of the generated sound waves travel through the acoustic cavity 112 to the back plate 258 of the frame 102. The traveling soundwaves resonate off the interior facing side 221 of back plate 258 and exit the acoustic cavity 112/expanded speaker assembly 106 through ports 310 (FIGS. 4 and 7) time delayed but in phase with the soundwaves that exited earlier through the speaker elements 108. The resonated soundwaves exiting through ports 310 thus combine with and accentuate the soundwaves output previously through speaker elements 108. The resulting effect is a rich acoustic quality audio production.

As illustrated in FIGS. 1A-1C and 2A-2C, typical use of the speaker apparatus 1000 in embodiments is as follows. A user compresses the speaker assembly 106 front to back to place it in the collapsed state 130 such as illustrated in FIG. 1A. Next, the user places the interfacing side 110 of the back plate 258 of the speaker apparatus 1000 (with speaker assembly 106 in the user selectable collapsed state 130) in contact with the planar surface 122 of the handheld device 120 wearing sleeve 126. The near face-to-face positioning of the interfacing surface 110 and target planar surface 122 allows the magnetic attraction and coupling between the handheld device 120/sleeve 126 and speaker apparatus 1000/backplate 258 as illustrated in FIG. 1B. The magnetic coupling is sufficiently strong so that the user can transport the speaker apparatus 1000 removably attached to the handheld device 120. The slim overall profile enables the user to conveniently transport the portable speaker 1000 and handheld device 120 together (combined in this fashion).

When the user wishes to play audio (e.g. music and the like) from the handheld device 120 through the speaker apparatus 1000, the user manually elongates or otherwise decompresses the speaker assembly 106 (and thus acoustic cavity 112) resulting in the expanded state 150 of the speaker assembly 106 shown in FIG. 1C. The magnetic or other coupling between speaker apparatus 1000 and handheld device 120 is sufficiently strong to remain while the user manually selectively changes the speaker assembly 106 between states, i.e. to and from collapsed state 130 of FIG. 1B and expanded state 150 of FIG. 1C. The user may optionally decouple (i.e. physically separate) the speaker apparatus 1000 from the handheld device 120 before or after expanding the speaker assembly 106 as further illustrated in FIG. 2A. In the resulting freestanding mode of speaker apparatus 1000, the user may sit the speaker apparatus 1000 on an upper planar surface such as a tabletop (for nonlimiting example) back plate 258 side down. During sound production through the speaker apparatus 1000, antivibration feet 261 of FIG. 2B in one embodiment assist in maintaining the speaker apparatus 1000 in place on that surface (table, wall, or other surface). In another embodiment, the retractable kickstand 128 of FIG. 2C assists in maintaining the speaker apparatus 1000 propped on the table surface or other upper planar surface.

Figure 3B:
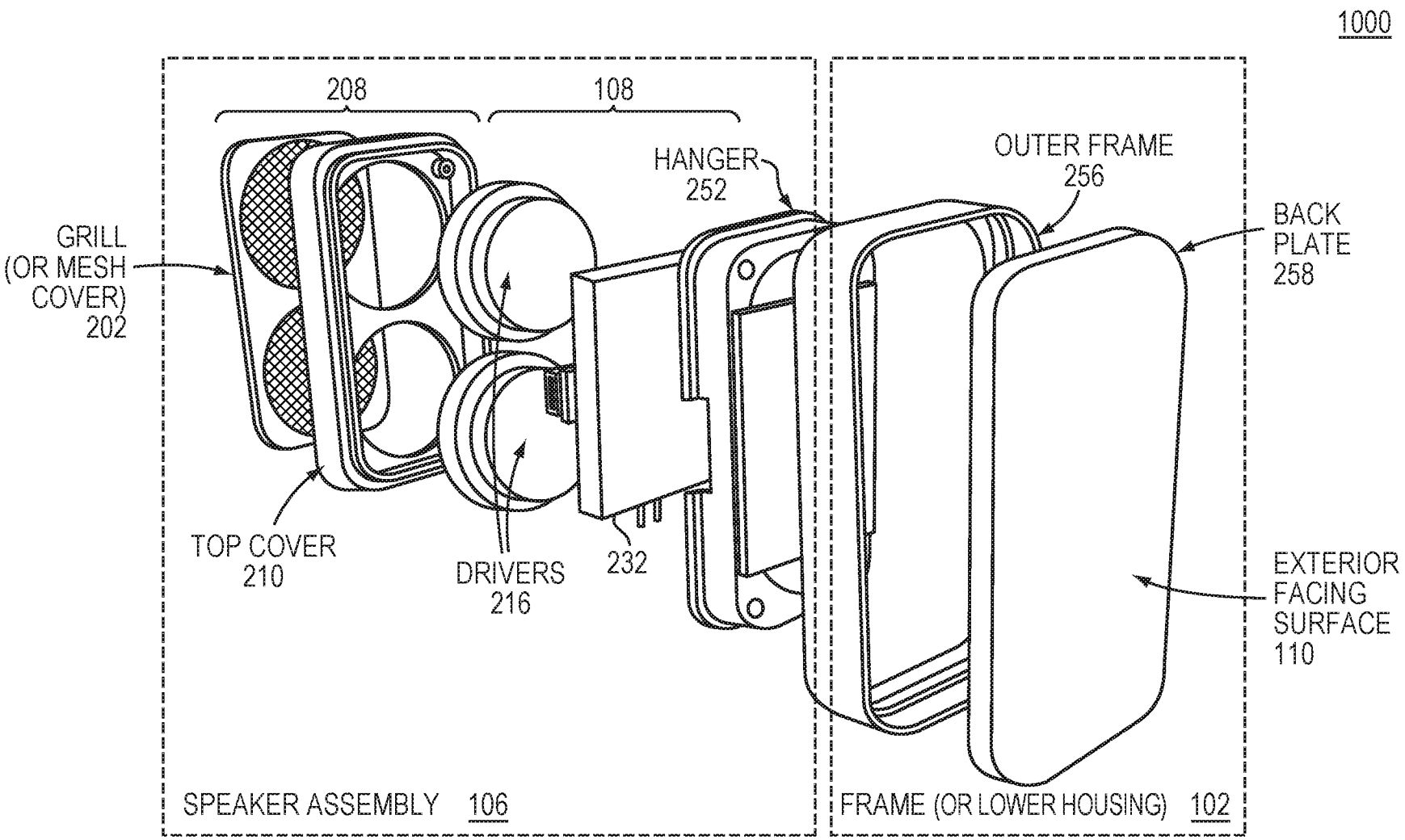
Figure 8:
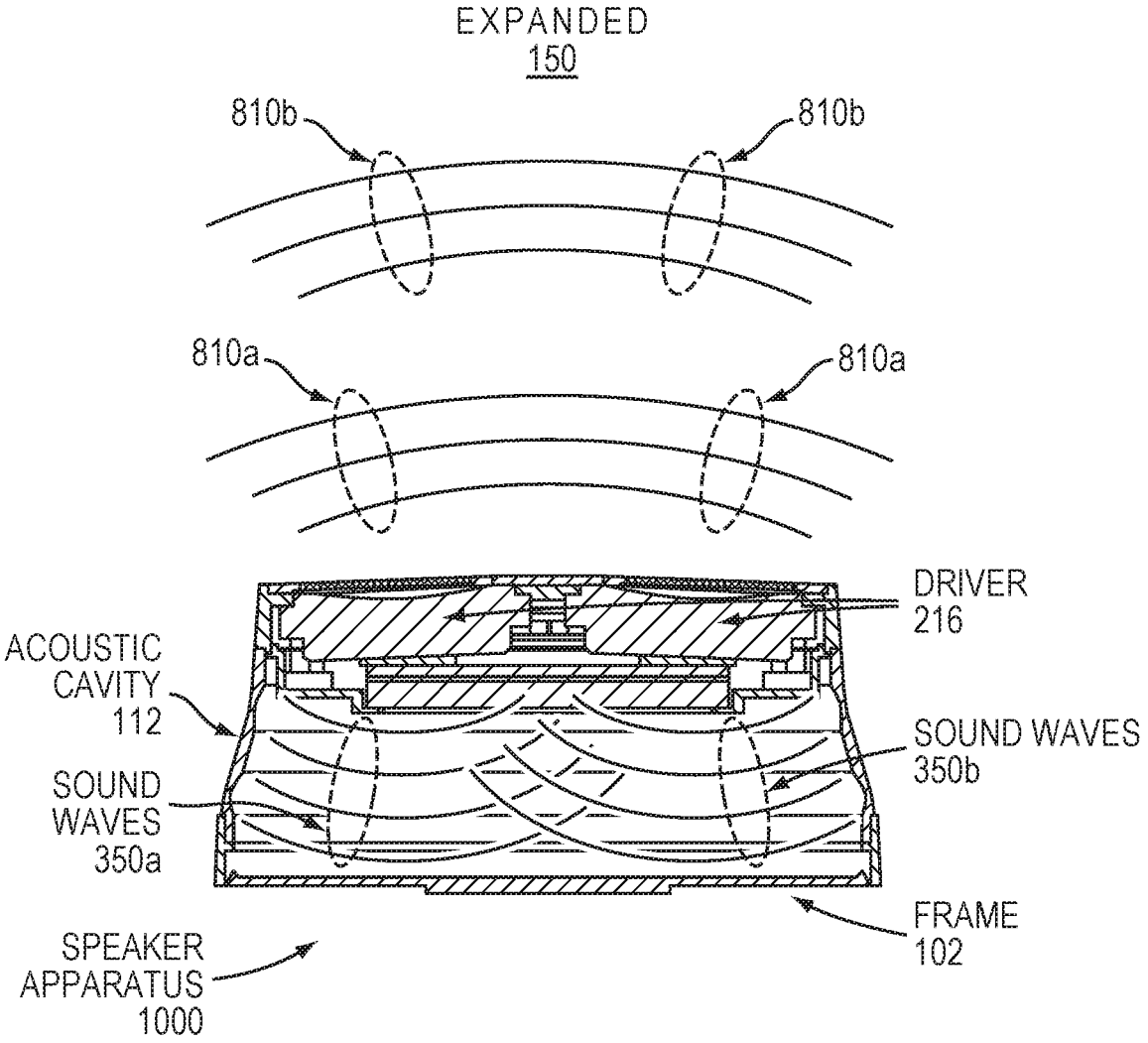

As mentioned above, for sound production through speaker apparatus 1000, the user powers on the speaker apparatus 1000 and pairs it with a source generating subject electrical input signal. Power and pair button 230, a multifunction actuator of FIG. 3A enables such operation in embodiments. Bluetooth or other wireless protocol and technology are employed. The source may be the handheld device 120 or other electronic devices such as a wireless radio/stereo/sound system, an electronic microphone, and the like. With reference to FIGS. 3A-3B and FIG. 8, drivers 216 of speaker elements 108 receive the source input signals and digitally transform them into audio signals (soundwaves, 810*a*, 810*b*, 350*a*, 350*b*). The drivers 216 deliver some of the generated audio signals 810*b* directly through the front panel 208 formed of a top cover 210 and mesh cover 202 for example. The drivers 216 channel remaining amounts of the generated audio signals (soundwaves 350*a*, 350*b*) into acoustic chamber 112 formed between the speaker elements 108 and the frame 102 when the speaker assembly 106 is in the expanded state 150. The audio signals/sound waves 350*a*, 350*b* (FIG. 8) travel through the acoustic chamber 112 and resonate off the interior facing side 221 (FIG. 3A) of back plate 258 in frame 102. The resonating waves 810*a* exit through portholes 310 (FIGS. 4 and 7) in the top cover 210. This portion of the exiting generated soundwaves 810*a* (through portholes 310) is time delayed relative to the first portion 810*b* of soundwaves exiting directly through front panel 208 from drivers 216. However, the two portions 810*a*, 810*b* of generated soundwaves are in phase with each other and thus complement each other. As a result, the two portions of exiting soundwaves 810*a*, 810*b* combine together in accentuating fashion (i.e., additive enhancing manner). In this way, the speaker apparatus 1000 delivers rich acoustic, enhanced quality audio or produced sound.

FIG. 3A-3B are exploded views of speaker assembly 106 and frame 102 of the speaker apparatus, system, and method 1000 in one embodiment. As illustrated, the speaker assembly 106 includes front panel 208, speaker elements 108, and hanger member 252. The front panel 208 comprises a grill (or mesh cover) 202, and top cover 210.

The speaker elements 108 include but are not limited to drivers 216, printed circuit board (PCB) or connector board 220, and battery or other power source 232. The PCB 220 carries the power and pair button/multifunction actuator 230, Universal Serial bus (USB) connector 226 and LEDs (with light pipe) 222 for indicating operations of power and pair button 230 and other operations. The printed circuit board 220 may also carry repeater transducer or similar transponder circuitry (actuated by button 228) for communicatively coupling speaker apparatus 1000 with other wireless speakers. Common or known in the art techniques are employed.

The hanger member 252 together with the front panel 208 effectively envelopes the speaker elements 108. In turn, this configuration of front panel 208, speaker elements 108, and hanger member 252 as an enveloped collection enables the speaker assembly 106 to move effectively as a single unit during user selectable expansion and collapsing of acoustic cavity 112. The elastomeric material 278 (FIGS. 1C, 2A) serves as a skin or exterior cover of speaker elements 108 and hanger member 252, in addition to forming walls of acoustic cavity 112. FIGS. 5A-6D are further illustrative.

Figure 6D:
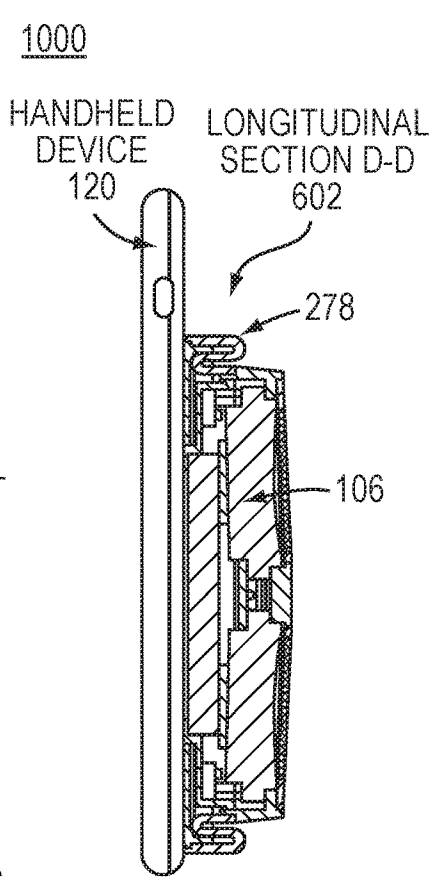
FIGS. 6A-6D are schematic and cross-sectional views of the collapsed state of the speaker apparatus, system, and method of the embodiment of FIGS. 5A-5D.
Figure 6C:
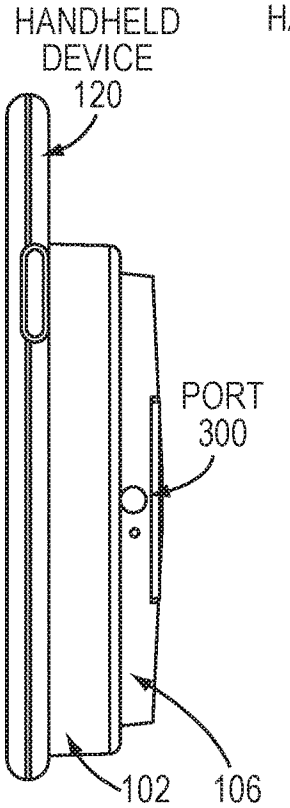
Figure 6B:
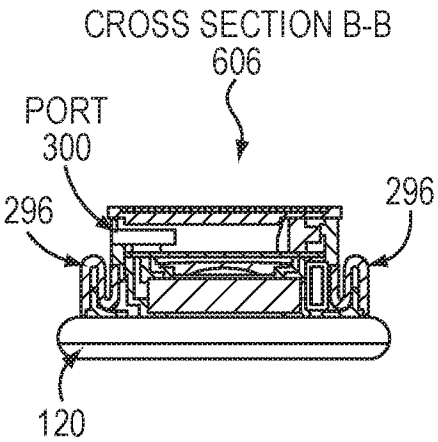
Figure 6A:
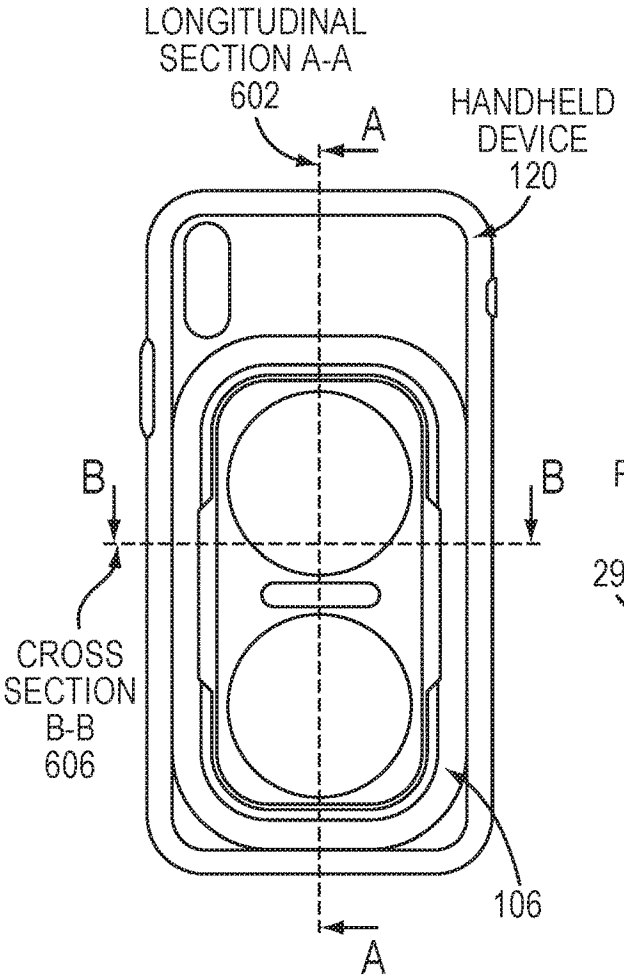

In particular, a forward or leading edge of the elastomeric material 278 is affixed to the perimeter of top cover 210 (FIGS. 1C, 2A). In one embodiment, the top cover 210 is of hard ABS or similar plastic material and the elastomeric material 278 is a thermoplastic elastomer or equivalent. Common cold molding and other molten connection techniques are utilized to form a smooth transition, i.e. flush seam, between the top cover 210 edge and elastomeric material 278. In addition, known techniques are used to form folding areas 296 (FIGS. 5B, 7E) in mid-portions of the elastomeric material 278 forming the acoustic cavity 112 walls about the acoustical chamber/volume. The folding areas 296 enable the user-selectable collapsing of cavity 112 walls and frame 102 accommodation of the speaker assembly 106 in collapsed state 130 as illustrated in FIGS. 6B, 6D and 7C. In the expanded state 150 of the speaker assembly 106, the cavity 112 walls are fairly smooth with thinned thickness at the folding areas 296 as show in FIGS. 5B, 5D and 7E. The back edge of elastomeric material 278 is affixed to the perimeter of outer frame 256 (of frame/lower housing 102) formed of ABS or similar plastic. Common or known molding and connection techniques are used.

Returning to FIGS. 3A-3B, in an embodiment, frame 102 includes but is not limited to back plate 258, magnets 280, and an outer frame 256. In an embodiment, the back plate 258 may be of ABS or other plastic material and may be sonic welded to outer frame 256. In other embodiments adhesive may be used to attach backplate 258 to outer frame 256. Magnets 280 may be sealed or otherwise held in interior facing side 221 of back plate 258. Other magnet configurations are suitable. For non-limiting example, alternative to back plate 258 carrying magnets 280 interior to the speaker apparatus 1000, other embodiments seat magnets 260 on the exterior facing side 110 of back plate 258 as mentioned above in FIG. 2B.

Figure 4:
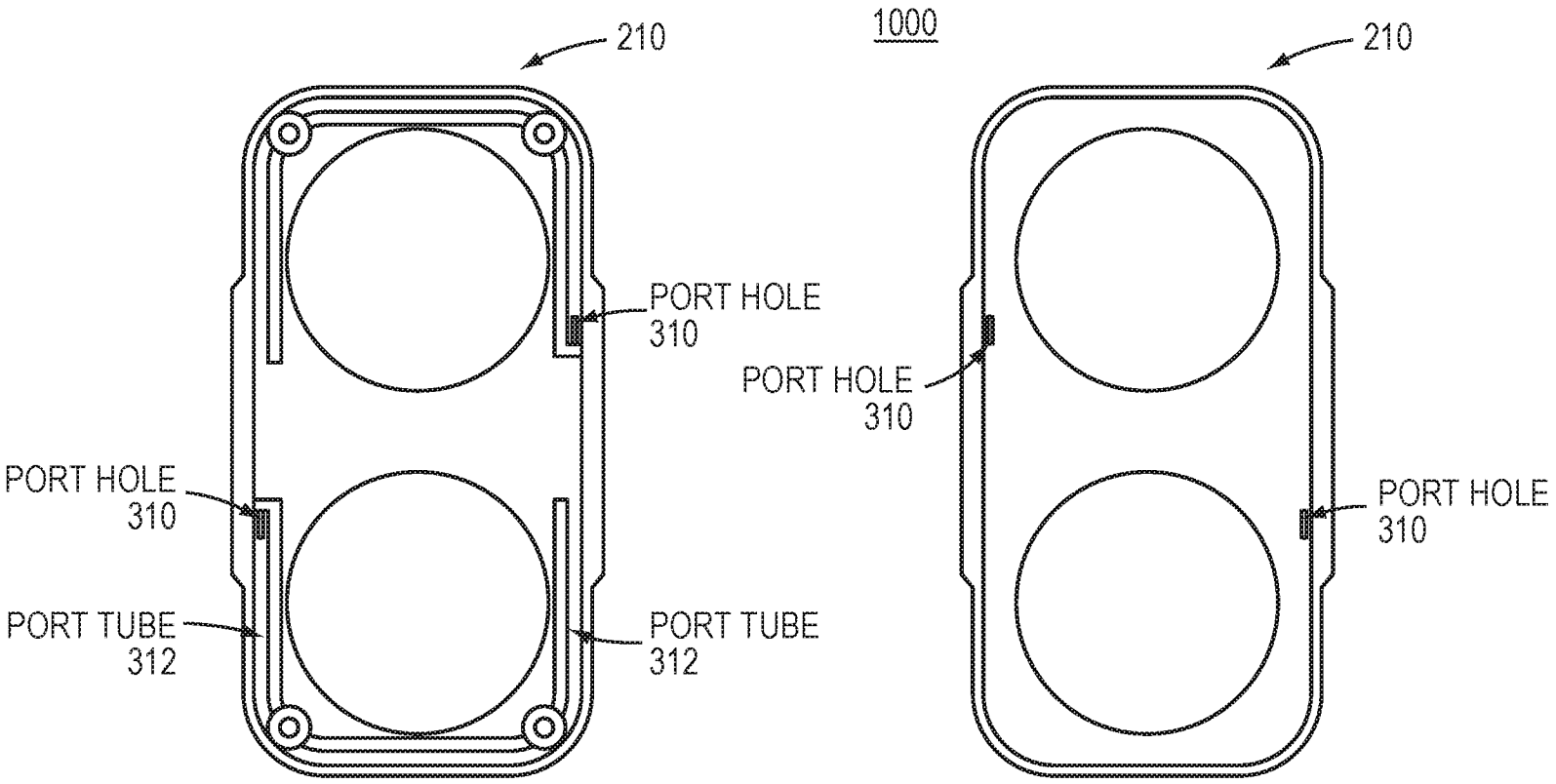
Figures 5A, 5B, 5C, 5D:
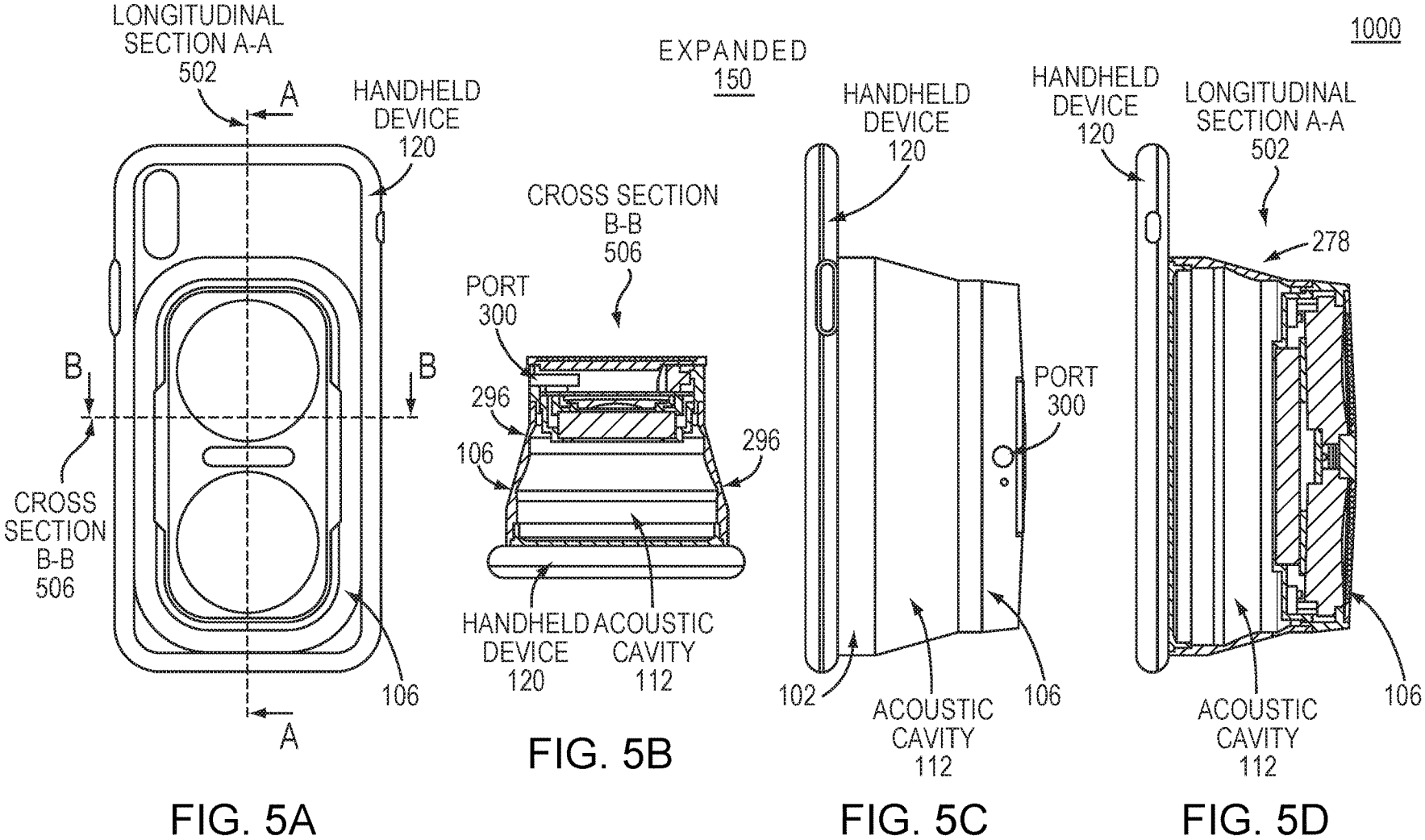
FIGS. 5A-5D are schematic and cross-sectional views of the expanded state of the speaker apparatus, system, and method of the embodiment of FIG. 1C.

FIG. 4 is a schematic view of the portholes 310 and port tubes 312 in top cover 210 of the speaker apparatus 1000 in one embodiment. As illustrated collectively between FIGS. 4 and 7, the speaker assembly 106 has portholes 310 for drawing air along one or more connecting port lines or tubes 312 to create the volume (e.g. acoustic cavity) 112 when being changed from the collapsed state 130 to the expanded state 150. The portholes 310 and tubes 312 thus form an airway system for enabling user selectable, manual (or by other means) expansion and collapsing of acoustic cavity 112. In addition to managing passing of air, the airway or port system (holes 310 and tubes 312) provides enhanced sound generation as detailed above. Other port system configurations are suitable as will be made clear below.

FIGS. 5A-6D are schematic and cross-sectional views of speaker apparatus 1000 with speaker assembly 106 in the expanded state 150 and the collapsed state 130 respectively. FIGS. 5A-5D and 6A-6D each illustrate a longitudinal section (section A-A) 502, 602 and a corresponding cross-section (Section B-B) 506, 606 of the acoustic cavity 112 of the speaker assembly 106 in the expanded state 150 and collapsed state 130 respectfully. Further, an alternative port 300 configuration is illustrated in side views FIGS. 5C and 6C and cross section views FIGS. 5B, 6B. Ports 300 draw and pass air for user selective expansion/collapsing of acoustic cavity 112 as well as release resonated sound waves similar to that described above in FIGS. 4 and 7.

FIG. 7A-7E are a schematic and cross-sectional views with dimensional characteristics of the speaker apparatus, system, and method 1000 in one embodiment.

FIG. 7A illustrates port holes 310 of FIG. 4 in more detail. Example dimensions of port holes 310 may include but are not limited to an outer diameter about 9 mm (0.35 inch), lip, or thickness of about 1 mm (0.04 inch), as shown in FIG. 7A.

Dimensions of depth 116, height 132, and width 732 are shown collectively in FIGS. 7B, 7D, and 7E. FIGS. 7B and 7C illustrate corresponding width 732 and depth or profile 116 dimensions for the speaker apparatus 1000, in the collapsed state 130. FIGS. 7D and 7E illustrate corresponding depth or profile 116 dimensions or height 132 dimensions for the speaker apparatus 1000, in the expanded state 150.

In addition, FIGS. 7C and 7E illustrate non-limiting example location and relative spacing of speaker assembly 106 components including one or more USBs 226, one or more PCBs 212, 220, a power and pair button 230, repeater button 228, one or more drivers 216, and one or more batteries 232.

Given the foregoing descriptions and examples, one of ordinary skill in the art can appreciate the following features and advantages of the speaker apparatus, system, and method 1000 of the present invention. The portable speaker 1000 uses the rear surface of the smartphone (or hand-held device) 120 as an integral part of the acoustical package. The speaker apparatus 1000 depends on the stiff surface 122 of the hand-held device 120 to support optimal sound reproduction, especially in the bass frequencies below 200 Hz. This is critical because an unsupported surface may allow the acoustical cavity 112 to stretch in unwanted ways, reducing the effectiveness and efficiency of the passive radiator, and/or port system (port holes) 300, 310.

According to some embodiments, the speaker drivers 216 are mounted on the front top cover plate 210 of the speaker assembly 106 spaced apart from the expanding acoustic cavity 112. In this configuration, the speaker drivers 216 can vibrate freely independently from the hand-held device 120, and thusly act as a passive radiator.

According to some embodiments, the small passageways (or port holes) 300, 310 that allow air to escape from a collapsible acoustic cavity 112 of portable speaker 1000, are tuned to subsonic resonance below 20 Hz, and allow the air pressure to be relieved while not audibly changing the sound of the speaker 1000. This is critical to the operation of collapsible speakers 1000 since if air was not allowed to enter the acoustic cavity 112, the elastomeric cavity walls 278 may not be able to expand 150.

According to some embodiments, features of the speaker apparatus, system, and method 1000 include but are not limited to the following: (1) an expandable 150 acoustic cavity 112 that provides a threshold volume; (2) a dual ported design which serves the purpose of letting air in or out during expanding (150) or collapsing (130) and acoustic tuning; (3) a phone (target hand-held device 120) chassis that may be used as an integral part of the stiffness needed for sound reproduction; (4) a near square foot print that maximizes acoustic volume 112 on the back of the phone/target device 120; (5) elastomeric material 278 that can be configured to act as a passive radiator as well as a ported 300, 310 enclosure; (6) a restricted passageway geometry of the air transfer between the airspace on the front-side and the back-side of the PCB 220 that enhances the acoustic properties of portable speaker 1000; and (7) an acoustic cavity 112 formed of a hard back-panel 258 and relatively soft sides (walls) that allow air pressure to push the back plate 258 as a single piston, and that act like a passive radiator, thereby providing a more direct sound than in existing approaches.

The teachings of all patents, published applications and references cited herein are incorporated by reference in their entirety.

While example embodiments have been particularly shown and described, it will be understood by those skilled in the art that various changes in form and details may be made therein without departing from the scope of the embodiments encompassed by the appended claims.

For example, the above mentions user-selectable magnetic coupling between a target hand held device 120 and speaker apparatus 1000 of the present invention. Other user-selectable coupling mechanisms and designs are within the purview of those skilled in the art given the present disclosure. The above mentions example dimensions, materials, and geometries for nonlimiting purposes. Other dimensions, materials, and geometries are suitable and within the purview of the skilled artisan given this disclosure.

What is claimed is:

1. A speaker apparatus comprising:

a speaker assembly comprising speaker elements; and a frame, the frame including a back plate, the back plate having an exterior facing surface on one side and an interior facing surface on an opposite side, the exterior facing surface being configured to cooperate with a target planar surface, and the frame carrying the speaker assembly across a space from the interior facing surface of the back plate; and the speaker assembly having a user selectable collapsed state and a user selectable expanded state, so that in the collapsed state the speaker assembly (i) minimizes an overall profile of the speaker apparatus and (ii) minimizes outward extension of the speaker elements relative to the back plate, and in the expanded state the speaker assembly has an acoustic cavity formed between the speaker elements and the back plate, the interior facing surface of the back plate serving as a relatively stiffer wall than other walls of the acoustic cavity, said other walls being formed of elastomeric material, and the interior facing surface of the back plate enabling sound waves to resonate in the acoustic cavity in a manner that improves quality of sound output.

2. The speaker apparatus of claim 1, wherein the exterior facing surface and the target planar surface are user-selectively coupled to each other.

3. The speaker apparatus of claim 1, wherein the target planar surface is a table surface, and the exterior facing surface of the back plate further includes contact areas configured for anti-vibration.

4. The speaker apparatus of claim 1, wherein the speaker assembly has port holes enabling drawing an amount of air to create the acoustic cavity.

5. The speaker apparatus of claim 4, wherein a portion of the sound waves resonate in the acoustic cavity and exit the acoustic cavity through the port holes subsequently combining in phase with other portions of the resonated sound waves that exit the acoustic cavity through the speaker elements.

6. The speaker apparatus of claim 1, wherein the speaker elements include any combination of a power source, a paring mechanism, a transponder-repeater, a universal serial bus (USB) connector, and a sound driver.

7. The speaker apparatus of claim 1, wherein the speaker assembly employs elastomeric material that forms the other walls of the acoustic cavity, and the acoustic cavity is user-selectably collapsible implementing the collapsed state of the speaker assembly, and the acoustic cavity is user-selectably expandable implementing the expanded state of the speaker assembly.

8. The speaker apparatus of claim 1, wherein input signals are wirelessly communicated to and received by the speaker assembly.

9. The speaker apparatus of claim 1 wherein the speaker assembly and frame have dimensions that enable the speaker apparatus to be hand held and portable.

10. The speaker apparatus of claim 1, wherein the target planar surface is a surface of a wall.

11. The speaker apparatus of claim 1, wherein the target planar surface is a surface of a door.

12. A method of producing sound through a portable speaker comprising:

(A) providing a portable speaker formed of:

a speaker assembly comprising speaker elements; and a frame, the frame including a back plate, the back plate having an exterior facing surface on one side and an interior surface on an opposite side, the exterior facing surface being configured to cooperate with a target planar surface, and the frame carrying the speaker assembly across a space from the interior surface of the back plate; and the speaker assembly having a user selectable collapsed state and a user selectable expanded state, so that in the collapsed state the speaker assembly minimizes outward extension of the speaker elements relative to the back plate, and in the expanded state the speaker assembly has an acoustic cavity formed between the speaker elements and the back plate; and (B) configuring the interior surface of the back plate as a relatively stiffer wall than other walls of the acoustic cavity so that sound waves resonate in the acoustic cavity in a manner that improves quality of sound output, said other walls of the acoustic cavity being formed of elastomeric material.

13. The method of claim 12 further comprising: configuring the exterior facing surface of the back plate to user-selectively couple to the target planar surface.

14. The method of claim 12 further comprising providing the speaker assembly with port holes for drawing air to create the acoustic cavity.

15. The method of claim 14, wherein a portion of the sound waves resonates in the acoustic cavity and exits the acoustic cavity through the port holes subsequently combining in phase with other portions of the resonated sound waves that exit the acoustic cavity through the speaker elements.

16. The method of claim 12 wherein the speaker assembly employs elastomeric material that forms the other walls of the acoustic cavity.

17. The method of claim 12 further comprising wirelessly receiving input signals at the portable speaker.

18. The method of claim 12 wherein the target planar surface is a table surface.

19. The method of claim 12 wherein the target planar surface is a surface of a wall.

20. The method of claim 12 wherein the target planar surface is a surface of a door.

* * * * *